US009957811B2

(12) United States Patent
Hucker et al.

(10) Patent No.: US 9,957,811 B2
(45) Date of Patent: May 1, 2018

(54) COOLED COMPONENT

(71) Applicant: ROLLS-ROYCE PLC, London (GB)

(72) Inventors: Paul A Hucker, Bristol (GB); Stephen C Harding, Bristol (GB); Alan P Geary, Bristol (GB)

(73) Assignee: ROLLS-ROYCE plc, London (GB)

( * ) Notice: Subject to any disclaimer, the term of this patent is extended or adjusted under 35 U.S.C. 154(b) by 261 days.

(21) Appl. No.: 14/872,511

(22) Filed: Oct. 1, 2015

(65) Prior Publication Data

US 2016/0123156 A1 May 5, 2016

(30) Foreign Application Priority Data

Oct. 30, 2014 (GB) ..... 1419327.0

(51) Int. Cl.
*F01D 5/00* (2006.01)
*F01D 5/18* (2006.01)
(Continued)

(52) U.S. Cl.
CPC ..... *F01D 5/186* (2013.01); *F01D 5/188* (2013.01); *F01D 9/065* (2013.01); *F23R 3/002* (2013.01);
(Continued)

(58) Field of Classification Search
CPC ..... F05D 2260/202; F05B 2260/202; F23R 2900/00018; F23R 2900/03041–2900/03043; F23R 3/002
See application file for complete search history.

(56) References Cited

U.S. PATENT DOCUMENTS 4,773,593 A 9/1988 Auxier et al.
5,941,686 A 8/1999 Gupta et al.
(Continued)

FOREIGN PATENT DOCUMENTS

EP 0 945 593 A1 9/1999
EP 0985802 A1 3/2000
(Continued)

OTHER PUBLICATIONS

Mar. 7, 2016 Extended Search Report issued in European Patent Application No. 15187835.2.
(Continued)

*Primary Examiner* — Pascal M Bui Pho
*Assistant Examiner* — Katheryn Malatek
(74) *Attorney, Agent, or Firm* — Oliff PLC

(57) ABSTRACT

A cooled gas turbine engine component comprises a wall having first and second surfaces. The second surface has a plurality of recesses and each recess has a planar upstream end surface arranged so that it hangs over the upstream end of the recess. Each recess has a depth equal to the required depth plus the thickness of the thermal barrier coating to be deposited. The wall has a plurality of angled effusion cooling apertures extending from the first surface towards the second surface. Each effusion cooling aperture has an inlet in the first surface and an outlet in the end surface of a corresponding one of the recesses in the second surface. Each recess has smoothly curved transitions from the end surface and side surfaces to the second surface. Blocking of the effusion cooling apertures by thermal barrier coating is reduced.

25 Claims, 11 Drawing Sheets

(51) Int. Cl.
*F01D 9/06* (2006.01)
*F23R 3/00* (2006.01)

(52) U.S. Cl.
CPC ..... *F23R 3/005* (2013.01); *F05B 2260/202* (2013.01); *F05D 2240/81* (2013.01); *F05D 2260/202* (2013.01); *F23R 2900/00018* (2013.01); *F23R 2900/03041* (2013.01); *F23R 2900/03042* (2013.01); *F23R 2900/03043* (2013.01)

(56) References Cited

U.S. PATENT DOCUMENTS

| | | | |
|---|---|---|---|
| 6,335,078 | B2 | 1/2002 | Venkataramani et al. |
| 6,383,602 | B1 | 5/2002 | Fric et al. |
| 6,847,004 | B2 | 1/2005 | Das et al. |
| 2005/0286998 | A1 | 12/2005 | Lee et al. |
| 2007/0025852 | A1 | 2/2007 | Camhi et al. |
| 2008/0271457 | A1 | 11/2008 | McMasters et al. |
| 2008/0286090 | A1 | 11/2008 | Okita |
| 2009/0184203 | A1 | 7/2009 | Briere |
| 2010/0192588 | A1 | 8/2010 | Gerendas |
| 2012/0051941 | A1 | 3/2012 | Bunker |
| 2012/0102959 | A1 | 5/2012 | Starkweather |
| 2012/0167389 | A1 | 7/2012 | Lacy et al. |
| 2014/0150455 | A1 | 6/2014 | Roberts, Jr. et al. |
| 2014/0161585 | A1 | 6/2014 | Arness et al. |
| 2014/0219814 | A1* | 8/2014 | Heselhaus ..... F01D 5/186 416/96 R |
| 2016/0061451 | A1* | 3/2016 | Dudebout ..... F23R 3/06 60/806 |

FOREIGN PATENT DOCUMENTS

| | | | |
|---|---|---|---|
| EP | 2 082 823 | A2 | 7/2009 |
| EP | 2641992 | A2 | 9/2013 |
| EP | 2641993 | A2 | 9/2013 |
| GB | 2461897 | A | 1/2010 |
| JP | 2013-167205 | A | 8/2013 |

OTHER PUBLICATIONS

Apr. 30, 2015 Search Report issued in British Patent Application No. 1419327.0.

* cited by examiner

COOLED COMPONENT

FIELD OF THE INVENTION

The present invention relates to a cooled component and in particular to a cooled component of gas turbine engine.

BACKGROUND TO THE INVENTION

Components, for example turbine blades, turbine vanes, combustion chamber walls, combustion chamber tiles, of gas turbine engines and other turbomachines are cooled to maintain the component at a temperature where the material properties of the component are not adversely affected and the working life and the integrity of the component is maintained.

One method of cooling components, turbine blades, turbine vanes, combustion chamber walls, combustion chamber tiles, of gas turbine engines provides a film of coolant on an outer surface of a wall of the component. The film of coolant is provided on the outer surface of the wall of the component by a plurality of effusion cooling apertures which are either arranged perpendicular to the outer surface of the wall or at an angle to the outer surface of the wall. The effusion apertures are generally manufactured by laser drilling, but other processes may be used, e.g. electro-chemical machining or electro-discharge machining. Effusion cooling apertures are often cylindrical and angled in the direction of flow of hot fluid over the outer surface of the component. Angled effusion cooling apertures have an increased internal surface area, compared to effusion cooling apertures arranged perpendicular to the outer surface of the wall of the component, and the increased internal surface area increases the heat transfer from the wall of the component to the coolant. Angled effusion apertures provide a film of coolant on the outer surface of the component which has improved quality compared to effusion cooling apertures arranged perpendicular to the outer surface of the wall of the component.

In addition a thermal barrier coating is applied onto the outer surface of the wall of the component to further reduce the temperature of the component due to convective and radiant heat transfer, to improve the thermal shock capability of the material of the component and to protect the component against corrosion and oxidation.

A number of problems arise when providing a thermal barrier coating onto the outer surface of a component which is to be cooled.

One method of manufacturing a cooled component with a thermal barrier coating is to deposit the thermal barrier coating onto the outer surface of the component and then drill the effusion cooling apertures through the thermal barrier coating and the wall of the component. However, this may result in the loss of the thermal barrier coating immediately adjacent to the effusion cooling apertures and this may lead to early failure of the component due to hot spots, oxidation and/or corrosion.

Another method of manufacturing a cooled component with a thermal barrier coating is to drill the effusion cooling apertures through the wall of the component and then to deposit the thermal barrier coating onto the outer surface of the wall of the component. However, this may result in blockage or partial blockage of one or more of the effusion cooling apertures and this may result in early failure of the component due to hot spots. It is known to use various methods to prevent blockage of the effusion cooling apertures by providing temporary fillers in the effusion cooling apertures during the deposition of the thermal barrier coating, but this necessitates the additional expense of removing all of the temporary fillers and inspecting to make sure all of the temporary fillers have been removed. It is also known to remove the blockage from the effusion cooling apertures after the thermal barrier coating has been deposited using high pressure water jets or abrasives etc, but this also necessitates the use of water jets and/or abrasive to remove the thermal barrier material blocking the effusion cooling apertures and inspecting to make sure all of the thermal barrier material blocking the apertures has been removed.

Therefore the present disclosure seeks to provide a novel cooled component which reduces or overcomes the above mentioned problem.

SUMMARY OF INVENTION

Accordingly the present invention provides a cooled component comprising a wall having a first surface and a second surface, the second surface having a plurality of recesses, each recess having an upstream end and a downstream end, each recess having a planar upstream end surface arranged at an angle of more than 100° to the second surface such that the planar upstream end surface hangs over the upstream end of the recess, each recess having a smoothly curved transition from the planar upstream end surface to the second surface, each recess reducing in depth from the upstream end of the recess to the downstream end of the recess, each recess having side surfaces arranged at an angle of less than 80° to the second surface and each recess having smoothly curved transitions from the side surfaces to the second surface, the wall having a plurality of effusion cooling apertures extending there-through from the first surface towards the second surface, the effusion cooling apertures being arranged at an angle to the first surface, each effusion cooling aperture having an inlet in the first surface and an outlet in a corresponding one of the recesses in the second surface, each effusion cooling aperture extending from the first surface to the planar upstream end surface of the corresponding one of the recesses in the second surface.

The side surfaces of the recesses may converge from the upstream end to the downstream end of the recess. The side surfaces of the recesses may diverge from the upstream end to the downstream end of the recess. The side surfaces of the recesses may be parallel from the upstream end to the downstream end of the recess. The side surfaces of each recess may converge from the upstream end to the downstream end of the recess. The side surfaces of each recess may diverge from the upstream end to the downstream end of the recess. The side surfaces of each recess may be parallel from the upstream end to the downstream end of the recess.

Each effusion cooling aperture may have a metering portion between the inlet and the outlet.

Each recess may have a triangular shaped opening in the second surface. Each recess may have a part elliptically shaped opening in the second surface.

Each effusion cooling aperture may have a metering portion and a diffusing portion arranged in flow series from the inlet to the outlet.

Each recess may have a quadrilateral shape opening in the second surface. Each recess may have a parallelogram shaped opening in the second surface. Each recess may have a rectangular shaped opening in the second surface. Each recess may have a square shaped opening in the second surface. Each recess may have an isosceles trapezium shaped opening in the second surface. Each recess may have a rhombus shaped opening in the second surface.

The bottom of each recess may be arranged parallel to the corresponding effusion cooling aperture.

The bottom of each recess may be continuously curved between the side surfaces of the recess or the bottom of each recess may be planar and is curved to connect with the side surfaces of the recess.

Each recess may have a planar upstream end surface arranged at an angle of 105° to the second surface.

Each recess may have side surfaces arranged at an angle of 75° to the second surface.

Each effusion cooling aperture may have an elliptically shaped inlet in the first surface.

Each effusion cooling aperture may have a circular cross-section metering portion.

Each effusion cooling aperture may diverge in the diffusion portion.

Each recess may be arranged such that the planar upstream end surface extends laterally and the side surfaces extend longitudinally.

The recesses may be arranged in longitudinally spaced rows and the recesses in each row being laterally spaced apart.

The effusion cooling apertures may be arranged in longitudinally spaced rows and the apertures in each row being laterally spaced apart.

The recesses in each row may be offset laterally from the recesses in each adjacent row.

The effusion cooling apertures in each row may be offset laterally from the effusion cooling apertures in each adjacent row.

The metering portion may be arranged at an angle of between 10° and 30° to the first surface. The metering portion may be arranged at an angle of 20° to the first surface.

The metering portion of the effusion cooling apertures may have a diameter of 0.4 mm.

The cooled component may have a thermal barrier coating on the second surface, each recess having a depth equal to the required depth plus the thickness of the thermal barrier coating to be deposited. The thermal barrier coating may have a thickness of 0.5 mm.

The effusion cooling apertures in each row may be spaced apart by 1 mm in the second surface and the effusion cooling apertures in adjacent rows may be spaced apart by 1 mm in the second surface.

The cooled component may comprise a second wall, the second wall having a third surface and a fourth surface, the fourth surface of the second wall being spaced from the first surface of the wall and the second wall having a plurality of impingement cooling apertures extending there-through from the third surface to the fourth surface.

The cooled component may be a turbine blade, a turbine vane, a combustion chamber wall, a combustion chamber tile, a combustion chamber heat shield, a combustion chamber wall segment or a turbine shroud.

The cooled combustion chamber wall may be an annular combustion chamber wall and the annular combustion chamber wall has each recess arranged such that the planar upstream end surfaces which extend laterally extend circumferentially of the combustion chamber wall and the side surfaces which extend longitudinally extend axially of the combustion chamber wall. The recesses may be arranged in axially spaced rows and the recesses in each row being circumferentially spaced apart. The effusion cooling apertures may be arranged in axially spaced rows and the apertures in each row being circumferentially spaced apart. The recesses in each row may be offset laterally from the recesses in each adjacent row. The effusion cooling apertures in each row may be offset circumferentially from the effusion cooling apertures in each adjacent row.

The cooled combustion chamber tile may be a combustion chamber tile for an annular combustion chamber wall and the combustion chamber tile has each recess arranged such that the planar upstream end surfaces which extend laterally extend circumferentially of the combustion chamber tile and the side surfaces which extend longitudinally extend axially of the combustion chamber tile. The recesses may be arranged in axially spaced rows and the recesses in each row being circumferentially spaced apart. The effusion cooling apertures may be arranged in axially spaced rows and the apertures in each row being circumferentially spaced apart. The recesses in each row may be offset laterally from the recesses in each adjacent row. The effusion cooling apertures in each row may be offset circumferentially from the effusion cooling apertures in each adjacent row.

The cooled combustion chamber wall segment may be a combustion chamber wall segment for an annular combustion chamber wall and the combustion chamber wall segment comprises an outer wall and an inner wall spaced from the inner wall, the outer wall has a plurality of impingement cooling apertures and the inner wall has a plurality of effusion cooling apertures, the inner wall has each recess arranged such that the planar upstream end surfaces which extend laterally extend circumferentially of the combustion chamber tile and the side surfaces which extend longitudinally extend axially of the combustion chamber tile. The recesses may be arranged in axially spaced rows and the recesses in each row being circumferentially spaced apart. The effusion cooling apertures may be arranged in axially spaced rows and the apertures in each row being circumferentially spaced apart. The recesses in each row may be offset laterally from the recesses in each adjacent row. The effusion cooling apertures in each row may be offset circumferentially from the effusion cooling apertures in each adjacent row.

The cooled turbine blade, or turbine vane, may have each recess arranged such that the planar upstream end surfaces which extend laterally extend radially of the turbine blade, or turbine vane, and the side surfaces which extend longitudinally extend axially of the turbine blade or turbine vane. The recesses may be arranged in axially spaced rows and the recesses in each row being radially spaced apart. The effusion cooling apertures may be arranged in axially spaced rows and the apertures in each row being radially spaced apart. The recesses in each row may be offset radially from the recesses in each adjacent row. The effusion cooling apertures in each row may be offset radially from the effusion cooling apertures in each adjacent row.

The cooled component may comprise a superalloy, for example a nickel, or cobalt, superalloy.

The thermal barrier coating may comprise a ceramic coating or a metallic bond coating and a ceramic coating. The ceramic coating may comprise zirconia, for example stabilised zirconia, e.g. yttria stabilised zirconia, ceria stabilised zirconia, yttria and erbia stabilised zirconia etc. The metallic bond coating may comprise an aluminide coating, e.g. a platinum aluminide coating, a chromium aluminide coating, a platinum chromium aluminide coating, a silicide aluminide coating or a MCrAlY coating where M is one or more of iron, nickel and cobalt, Cr is chromium, Al is aluminium and Y is a rare earth metal, e.g. yttrium, lanthanum etc.

The cooled component may be manufactured by additive layer manufacturing, for example direct laser deposition.

The cooled component may be a gas turbine engine component or other turbomachine component, e.g. a steam turbine, or an internal combustion engine etc.

The gas turbine engine may be an aero gas turbine engine, an industrial gas turbine engine, a marine gas turbine engine or an automotive gas turbine engine. The aero gas turbine engine may be a turbofan gas turbine engine, a turbo-shaft gas turbine engine, a turbo-propeller gas turbine engine or a turbojet gas turbine engine.

BRIEF DESCRIPTION OF THE DRAWINGS

The present disclosure will be more fully described by way of example with reference to the accompanying drawings, in which:—

DETAILED DESCRIPTION

Figure 1:
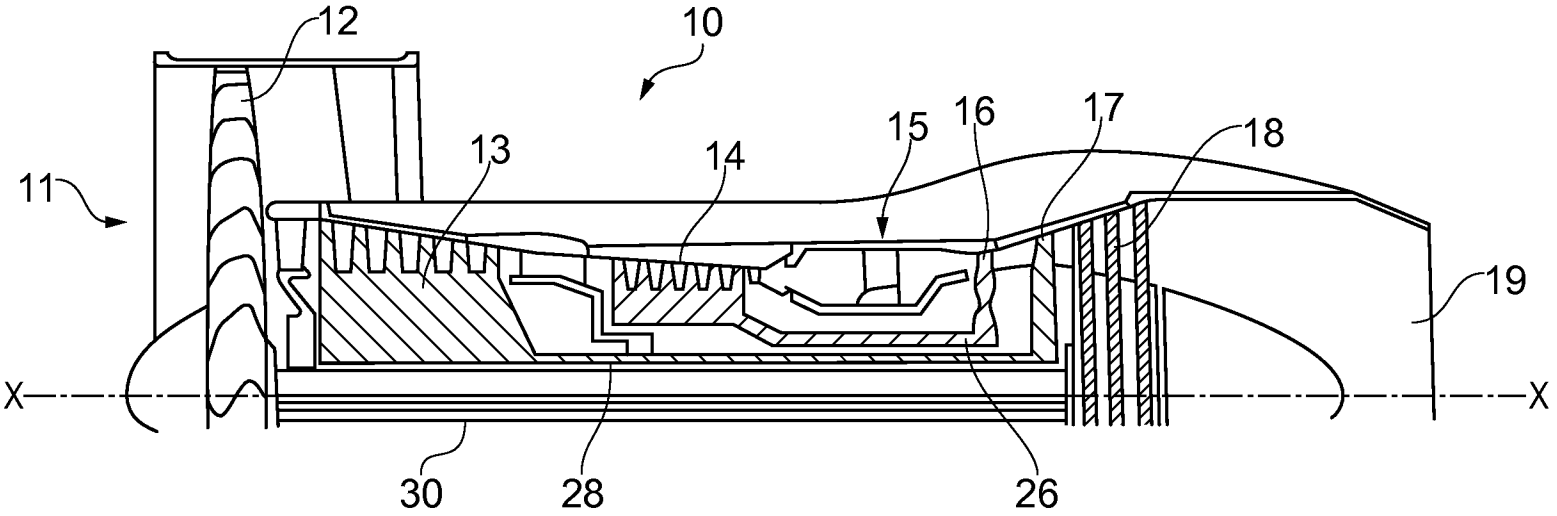
FIG. 1 is partially cut away view of a turbofan gas turbine engine having a cooled combustion chamber wall according to the present disclosure.

A turbofan gas turbine engine 10, as shown in FIG. 1, comprises in flow series an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 13 via a second shaft 28 and the low pressure turbine 18 is arranged to drive the fan 12 via a third shaft 30. In operation air flows into the intake 11 and is compressed by the fan 12. A first portion of the air flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine to provide propulsive thrust.

Figure 2:
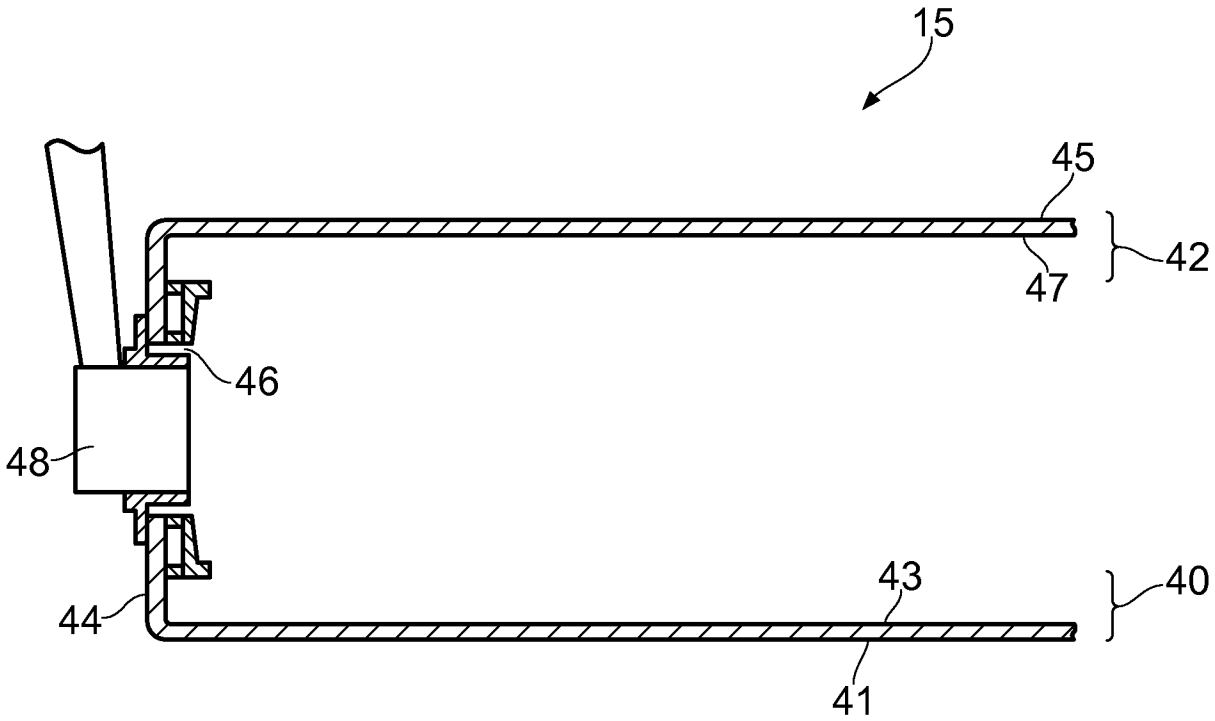
FIG. 2 is an enlarged cross-sectional view of a cooled combustion chamber wall according to the present disclosure.

The combustion chamber 15, as shown more clearly in FIG. 2, is an annular combustion chamber and comprises a radially inner annular wall 40, a radially outer annular wall structure 42 and an upstream end wall 44. The upstream end of the radially inner annular wall 40 is secured to the upstream end wall structure 44 and the upstream end of the radially outer annular wall 42 is secured to the upstream end wall 44. The upstream end wall 44 has a plurality of circumferentially spaced apertures 46 and each aperture 46 has a respective one of a plurality of fuel injectors 48 located therein. The fuel injectors 48 are arranged to supply fuel into the annular combustion chamber 15 during operation of the gas turbine engine 10 and as mentioned above the fuel is burnt in air supplied into the combustion chamber 15.

The radially inner annular wall 40 and the radially outer annular wall 42 are cooled components of the turbofan gas turbine engine 10. The radially inner annular wall 40 has a first surface 41 and a second surface 43 and similarly the radially outer annular wall 42 has a first surface 45 and a second surface 47.

Figure 6:
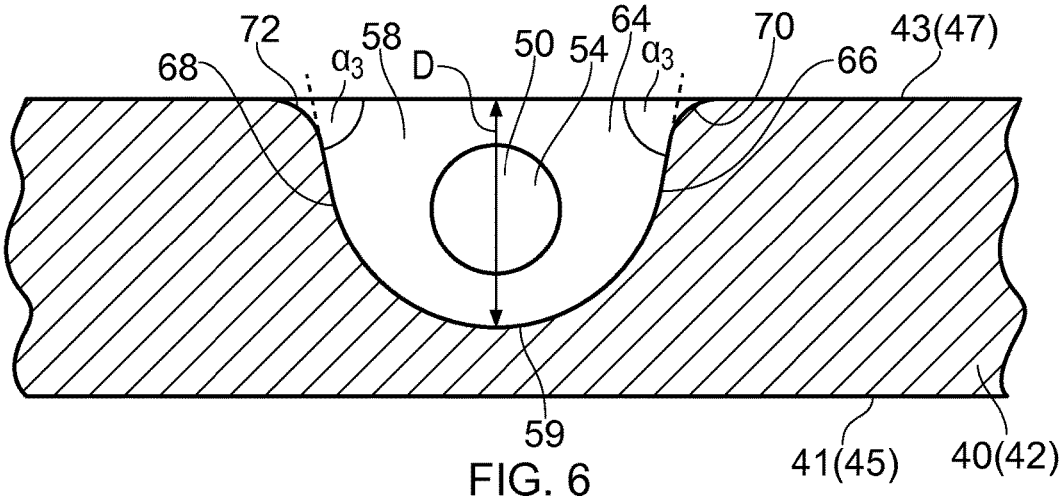
FIG. 6 is a cross-sectional view in the direction of arrows A-A in FIG. 5.
Figure 8:
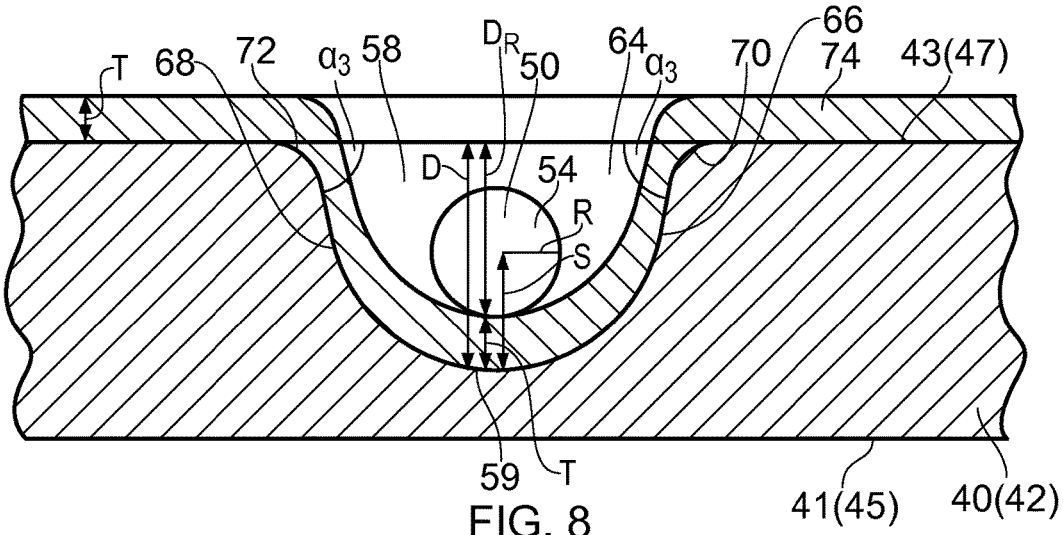
FIG. 8 is a cross-sectional view in the direction of arrows B-B in FIG. 7.
Figure 3:
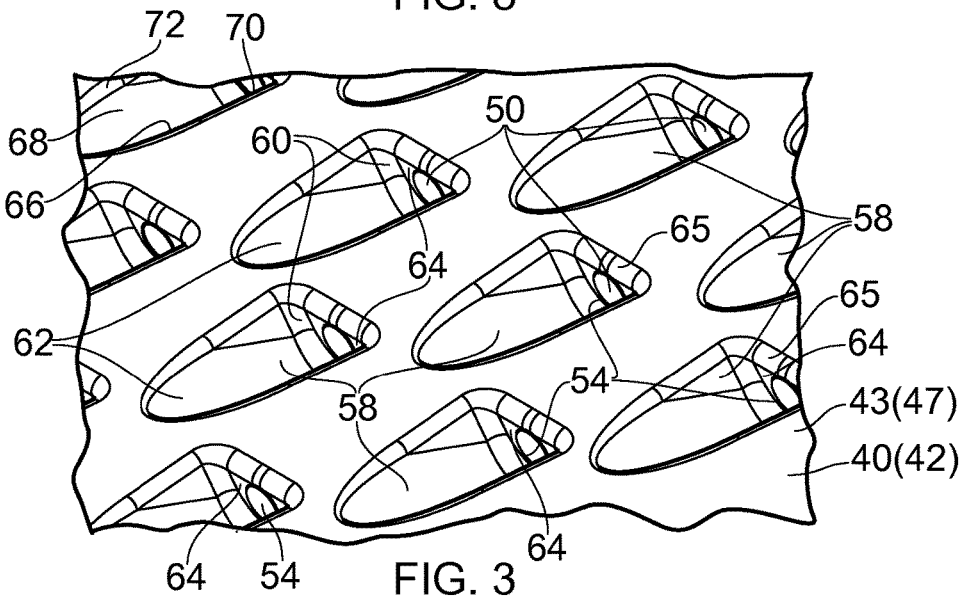
FIG. 3 is an enlarged perspective view of a portion of the second surface of the cooled combustion chamber wall shown in FIG. 2.
Figure 4:
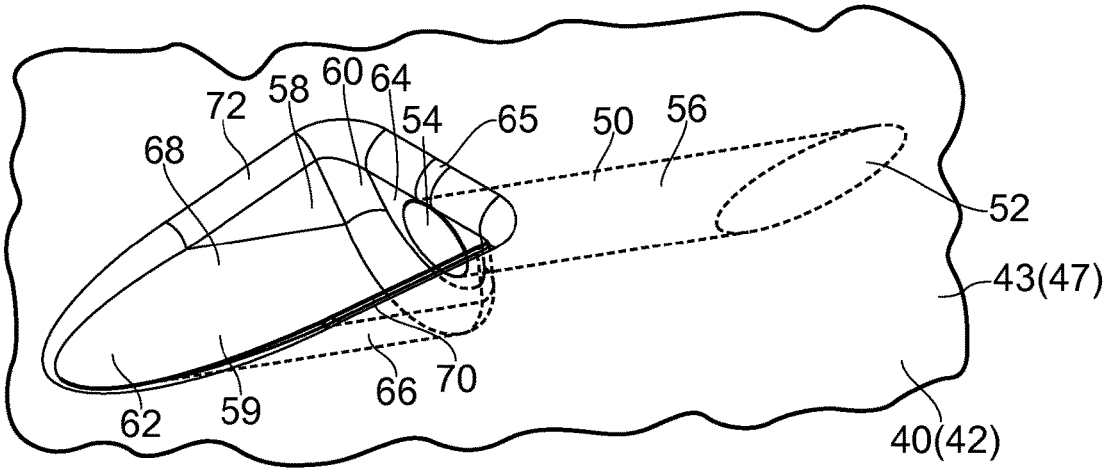
FIG. 4 is a further enlarged perspective view of a single recess in the second surface of the cooled combustion chamber wall shown in FIG. 3.
Figure 5:
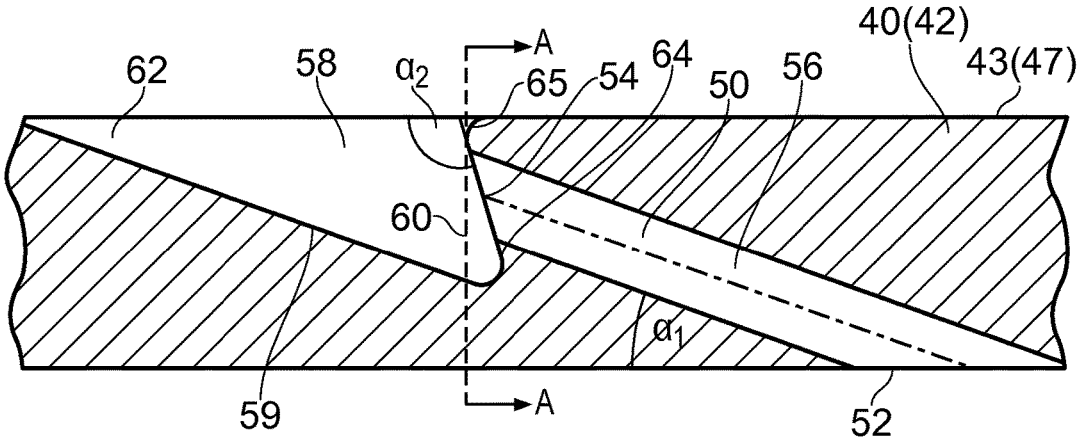
FIG. 5 is a longitudinal cross-sectional view of the cooled combustion chamber wall shown in FIG. 4.

The radially inner annular wall 40 has a plurality of effusion cooling apertures 50 extending there-through from the first surface 41 towards the second surface 43, as shown more clearly in FIGS. 3 to 8. The effusion cooling apertures 50 are arranged at an angle $\alpha_1$ to the first surface 41 and to the second surface 43, as shown in FIG. 5. Each aperture 50 has an inlet 52 in the first surface 41 and an outlet 54. The second surface 43 has a plurality of recesses 58 and each recess 58 has an upstream end 60 and a downstream end 62, as shown in FIG. 3. Each recess 58 has a planar upstream end surface 64 arranged at an angle $\alpha_2$ of more than 100° to the second surface 43 such that the planar upstream end surface 64 hangs over the upstream end 60 of the recess 58. Each recess 58 has a smoothly curved transition 65 from the planar upstream end surface 64 to the second surface 43. Each recess 58 reduces in depth from the upstream end 60 of the recess 58 to the downstream end 62 of the recess 58 and thus the bottom surface 59 of each recess 58 is also arranged at an angle $\alpha_1$ to the first surface 41 and to the second surface 43. The bottom surface 59 of each recess 58 is thus arranged parallel to the corresponding effusion cooling aperture 50, as shown in FIG. 5. Each recess 58 has side surfaces 66 and 68 arranged at an angle $\alpha_3$ of less than 80° to the second surface 43 and each recess 58 has smoothly curved transitions 70 and 72 from the side surfaces 66 and 68 respectively to the second surface 43. The bottom surface 59 of each recess 58 is continuously curved between the side surfaces 66 and 68 of the recess 58, as shown in FIG. 6. Each recess 58 has a depth D equal to the required depth $D_R$ plus the thickness T of a thermal barrier coating 74 to be deposited on the second surface 43. The depth D is measured from the second surface 43 to the bottom surface 59 of the recess 58, as shown in FIGS. 6 and 8.

Each effusion cooling aperture 50 as mentioned previously has an inlet 50 in the first surface 41 and the outlet 54 is in a corresponding one of the recesses 58 in the second surface 43 and in particular each effusion cooling aperture 50 extends from the first surface 41 to the planar upstream end surface 64 of the corresponding one of the recesses 58 in the second surface 43. Each effusion cooling aperture 50 has a metering portion 56 between the inlet 52 and the outlet 54, as clearly shown in FIGS. 4 and 5.

The side surfaces 66 and 68 of each recess 58 converge from the upstream end 60 to the downstream end 62 of the recess 58. Each recess 58 has a triangular shaped opening or a part elliptically shaped opening in the second surface 43, as shown in FIGS. 3 and 4.

In this particular example each recess 58 has a planar upstream end surface 64 arranged at an angle $\alpha_2$ of 105° to the second surface 43, each recess 58 has side surfaces 66 and 68 arranged at an angle $\alpha_3$ of 75° to the second surface 43, each effusion cooling aperture 50 has a circular cross-section metering portion 56 and each effusion cooling aperture 50 has an elliptically shaped inlet 52 in the first surface 42.

Figure 7:
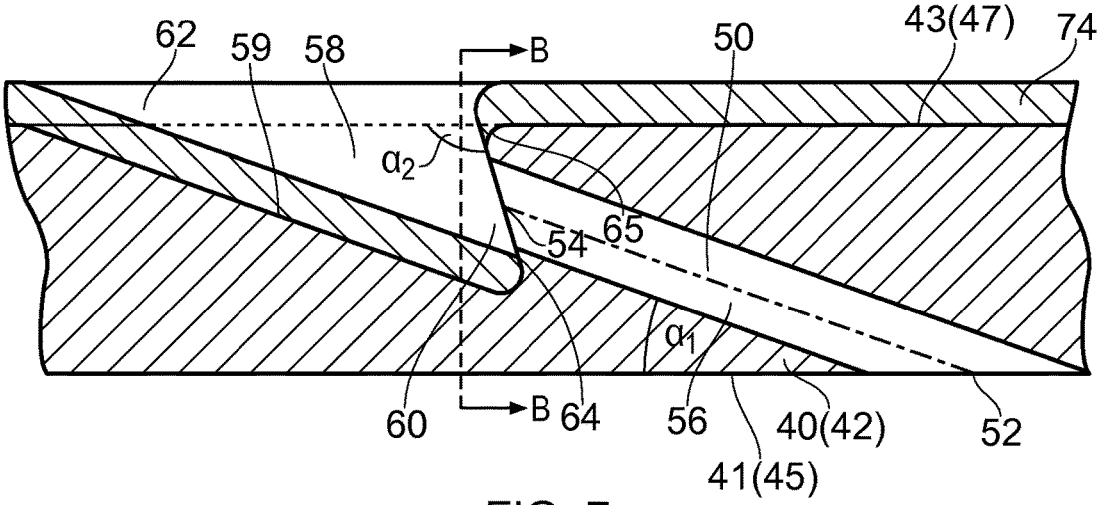
FIG. 7 is a longitudinal cross-sectional view of the cooled combustion chamber wall shown in FIG. 4 with a thermal barrier coating on the second surface.

The metering portion 56 of each effusion cooling aperture 50 is arranged at an angle $\alpha_1$ of between 10° and 30° to the first surface 41 and in this example the metering portion 56 of each effusion cooling aperture 50 is arranged at an angle $\alpha_1$ of 20° to the first surface 41. The metering portion 56 of each effusion cooling apertures 50 has a diameter of 0.4 mm. The second surface 43 has a thermal barrier coating 74 which has a thickness of 0.5 mm. It is to be noted that the outlet 54 of each effusion cooling aperture 50 is arranged in the planar upstream end surface 64 at a position such that it spaced from the bottom of the upstream end 60 of the recess 58 so that the thermal barrier coating 74 does not block the outlet 54, e.g. the distance S from the centre of the outlet 54 to the bottom surface 59 at the upstream end 60 of the recess 58 is at least equal to and preferably greater than the radius R of the outlet 54 and the thickness T of the thermal barrier coating 74, as shown in FIGS. 7 and 8. The bottom surface 59 at the upstream end 60 of each recess 58 in this example is an arc of a circle with a radius S, see FIGS. 6 and 8.

The effusion cooling apertures 50 are arranged in longitudinally spaced rows and the apertures 50 in each row are laterally spaced apart and in particular the effusion cooling apertures 50 are arranged in axially spaced rows and the apertures 50 in each row are circumferentially spaced apart. The effusion cooling apertures 50 in each row are offset laterally from the effusion cooling apertures 50 in each adjacent row and in particular the effusion cooling apertures 50 in each row are offset circumferentially from the effusion cooling apertures 50 in each adjacent row. Thus, the effusion cooling apertures 50 in the first surface 41 are arranged in axially spaced rows and the effusion cooling apertures 50 in each row are circumferentially spaced apart.

The recesses 58 are arranged in longitudinally spaced rows and the recesses 58 in each row are laterally spaced apart and in particular the recesses 58 are arranged in axially spaced rows and the recesses 58 in each row are circumferentially spaced apart. The recesses 58 in each row are offset laterally from the recesses 58 in each adjacent row and in particular the recesses 58 in each row are offset circumferentially from the recesses 58 in each adjacent row. Thus, the recesses 58 in the second surface 43 are also arranged in axially spaced rows and the recesses 58 in each row are circumferentially spaced apart, as shown more clearly in FIG. 3.

The recesses 58 are arranged such that the planar upstream end surfaces 64 extend circumferentially of the radially inner annular wall 40 of the annular combustion chamber 15 and the side surfaces 66 and 68 extend substantially axially or with axial and circumferential components of the radially inner annular wall 40 of the annular combustion chamber 15.

The radially outer annular wall 42 has a plurality of effusion cooling apertures 50 extending there-through from the first surface 41 towards the second surface 43 and a plurality of recesses 58 and each recess has an upstream end 60 and a downstream end 62, as shown more clearly in FIGS. 3 to 8 and these effusion cooling apertures 50 and recesses 58 are arranged substantially the same as the effusion cooling apertures 50 and recesses 58 in the radially inner annular wall 40.

In operation coolant, for example air supplied from the high pressure compressor 14 of the gas turbine engine 10, flowing over the radially inner and outer annular walls 40 and 42 respectively is supplied through the effusion cooling apertures 50 from the first surface 41 or 45 to the second surface 43 or 47 of the radially inner and outer annular walls 40 and 42 respectively. The flow of coolant through the effusion cooling apertures 50 exits the effusion cooling apertures 50 and then flows over the second surfaces 43 or 47 of the radially inner and outer annular walls 40 and 42 respectively to form a film of coolant on the second surfaces 43 or 47 of the radially inner and outer annular walls 40 and 42 respectively. In particular the flow of coolant exits the outlets 54, in the planar upstream end surfaces 64 of the recesses 58, of the effusion cooling apertures 50 and flows through the recesses 58 and onto the second surface 43 or 47 of the radially inner and outer annular walls 40 and 42 respectively.

Figure 9:
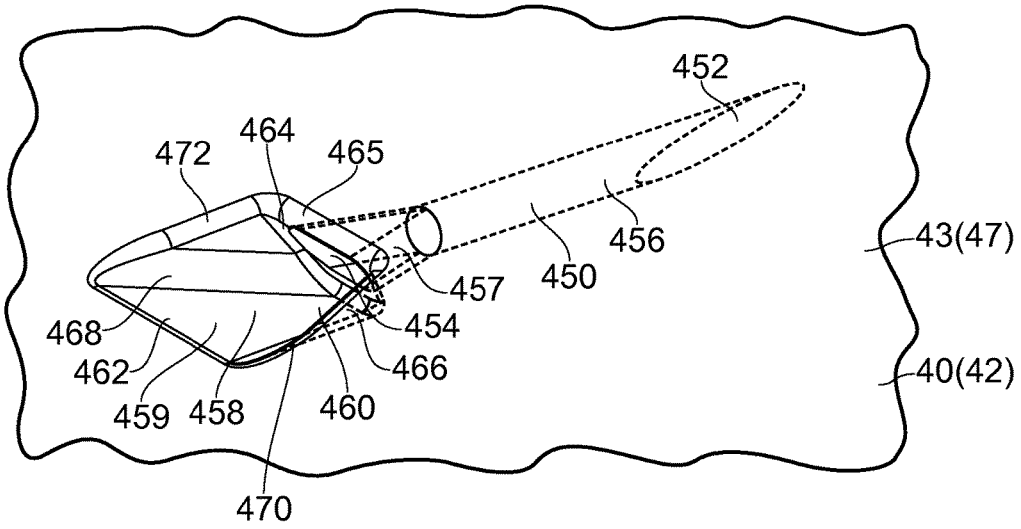
FIG. 9 is a further enlarged perspective view of an alternative recess in the second surface of the cooled combustion chamber wall shown in FIG. 3.

FIG. 9 shows a cooled component with an alternative effusion cooling aperture and recess. The radially inner annular wall 40 has a plurality of effusion cooling apertures 450 extending there-through from the first surface 41 towards the second surface 43. The effusion cooling apertures 450 are arranged at an angle $\alpha_1$ to the first surface 41 and to the second surface 43. Each aperture 450 has an inlet 452 in the first surface 41 and an outlet 454. The second surface 43 has a plurality of recesses 458 and each recess 458 has an upstream end 460 and a downstream end 462. Each recess 458 has a planar upstream end surface 464 arranged at an angle $\alpha_2$ of more than 100° to the second surface 43 such that the planar upstream end surface 464 hangs over the upstream end 460 of the recess 458. Each recess 458 has a smoothly curved transition 465 from the planar upstream end surface 464 to the second surface 43. Each recess 458 reduces in depth from the upstream end 460 of the recess 458 to the downstream end 462 of the recess 458 and each recess 58 has a depth equal to the required depth plus the thickness of a thermal barrier coating to be deposited on the second surface 43. Each recess 458 has side surfaces 466 and 468 arranged at an angle of less than 80° to the second surface 43 and each recess 458 has smoothly curved transitions 470 and 472 from the side surfaces 466 and 468 respectively to the second surface 43.

Each effusion cooling aperture 450 as mentioned previously has an inlet 450 in the first surface 41 and the outlet 454 is in a corresponding one of the recesses 458 in the second surface 43 and in particular each effusion cooling aperture 450 extends from the first surface 41 to the planar upstream end surface 464 of the corresponding one of the recesses 458 in the second surface 43.

The side surfaces 466 and 468 of the recesses 458 may diverge from the upstream end 460 to the downstream end 462 of the recesses 458. The side surfaces 466 and 468 of each recess 458 may diverge from the upstream end 460 to the downstream end 462 of the recess 458. Each recess 458 may having an isosceles trapezium shaped opening in the second surface 43. Alternatively, the side surfaces 466 and 468 of the recesses 458 may be parallel from the upstream end 460 to the downstream end 462 of the recesses 458. The side surfaces 466 and 468 of each recess 458 may be parallel from the upstream end 460 to the downstream end 462 of the recess 458. Each recess 458 may having a rectangular shaped opening in the second surface 43 or a square shaped opening in the second surface 43.

Each effusion cooling aperture 450 has a metering portion 456 and a diffusing portion 457 arranged in flow series from the inlet 450 to the outlet 454. Each effusion cooling aperture 450 diverges in the diffusion portion 457 from the metering portion 456 to the outlet 454 in the planar upstream end surface 464 of the recess 458.

The bottom surface 459 of each recess 458 is arranged parallel to the corresponding effusion cooling aperture 450. The bottom surface 459 of each recess 458 is planar and is curved to connect with the side surfaces 466 and 468 of the recess 458.

In this particular example each recess 458 has a planar upstream end surface 464 arranged at an angle $\alpha_2$ of 105° to the second surface 43, each recess 458 has side surfaces 466 and 468 arranged at an angle $\alpha_3$ of 75° to the second surface 43, each effusion cooling aperture 450 has a circular cross-section metering portion 456 and each effusion cooling aperture 450 has an elliptically shaped inlet 452 in the first surface 42. The metering portion 456 of each effusion cooling aperture 450 is arranged at an angle $\alpha_1$ of between 10° and 30° to the first surface 41 and in this example the metering portion 456 of each effusion cooling aperture 450 is arranged at an angle $\alpha_1$ of 20° to the first surface 41. The metering portion 456 of each effusion cooling apertures 450 has a diameter of 0.4 mm. The second surface 43 has a thermal barrier coating 74 which has a thickness of 0.5 mm. It is to be noted that the outlet 454 of each effusion cooling aperture 450 is arranged in the planar upstream end surface 464 at a position such that it spaced from the bottom of the upstream end 460 of the recess 458 so that the thermal barrier coating 74 does not block the outlet 454, e.g. the distance S from the centre of the outlet 454 to the bottom of the upstream end 460 of the recess 458 is at least equal to and preferably greater than the radius R of the outlet 454 and the thickness T of the thermal barrier coating 74.

The effusion cooling apertures 450 are arranged in longitudinally spaced rows and the apertures 450 in each row are laterally spaced apart and in particular the effusion cooling apertures 450 are arranged in axially spaced rows and the apertures 450 in each row are circumferentially spaced apart. The effusion cooling apertures 450 in each row are offset laterally from the effusion cooling apertures 450 in each adjacent row and in particular the effusion cooling apertures 450 in each row are offset circumferentially from the effusion cooling apertures 450 in each adjacent row. Thus, the effusion cooling apertures 450 in the first surface 41 are arranged in axially spaced rows and the effusion cooling apertures 450 in each row are circumferentially spaced apart.

The recesses 458 are arranged in longitudinally spaced rows and the recesses 458 in each row are laterally spaced apart and in particular the recesses 458 are arranged in axially spaced rows and the recesses 458 in each row are circumferentially spaced apart. The recesses 458 in each row are offset laterally from the recesses 458 in each adjacent row and in particular the recesses 458 in each row are offset circumferentially from the recesses 458 in each adjacent row. Thus, the recesses 458 in the second surface 43 are also arranged in axially spaced rows and the recesses 458 in each row are circumferentially spaced apart.

The recesses 458 are arranged such that the planar upstream end surfaces 464 extend circumferentially of the radially inner annular wall 40 of the annular combustion chamber 15 and the side surfaces 466 and 468 extend substantially axially of the radially inner annular wall 40 or with axial and circumferential components of the annular combustion chamber 15.

The effusion cooling apertures 450 and recesses 458 of FIG. 9 may also be provided in a combustion chamber tile, a combustion chamber heat shield, a combustion chamber segment, a turbine blade, a turbine vane or a turbine shroud.

Figure 10:
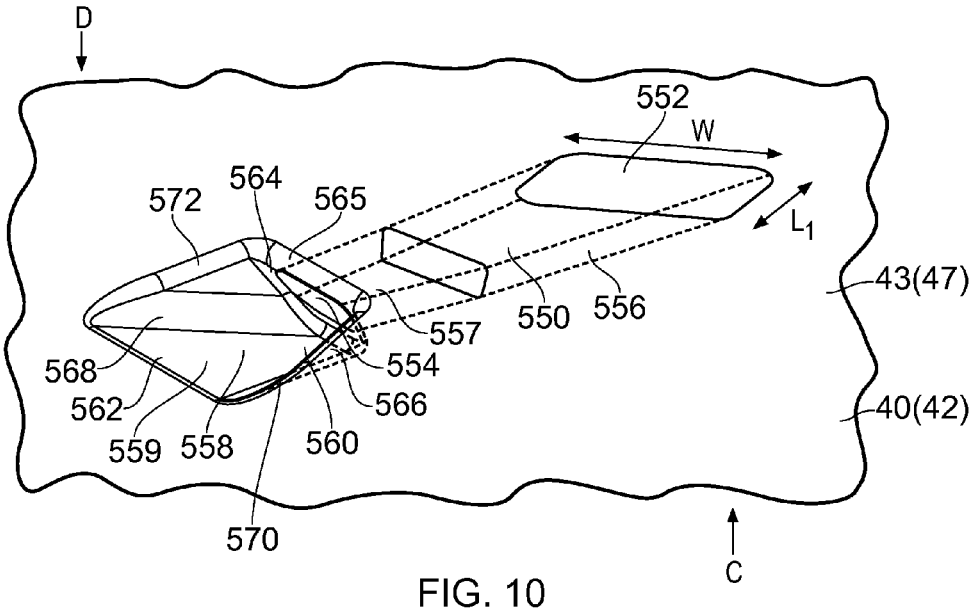
FIG. 10 is a further enlarged perspective view of another recess in the second surface of the cooled combustion chamber wall shown in FIG. 3.
Figure 11:
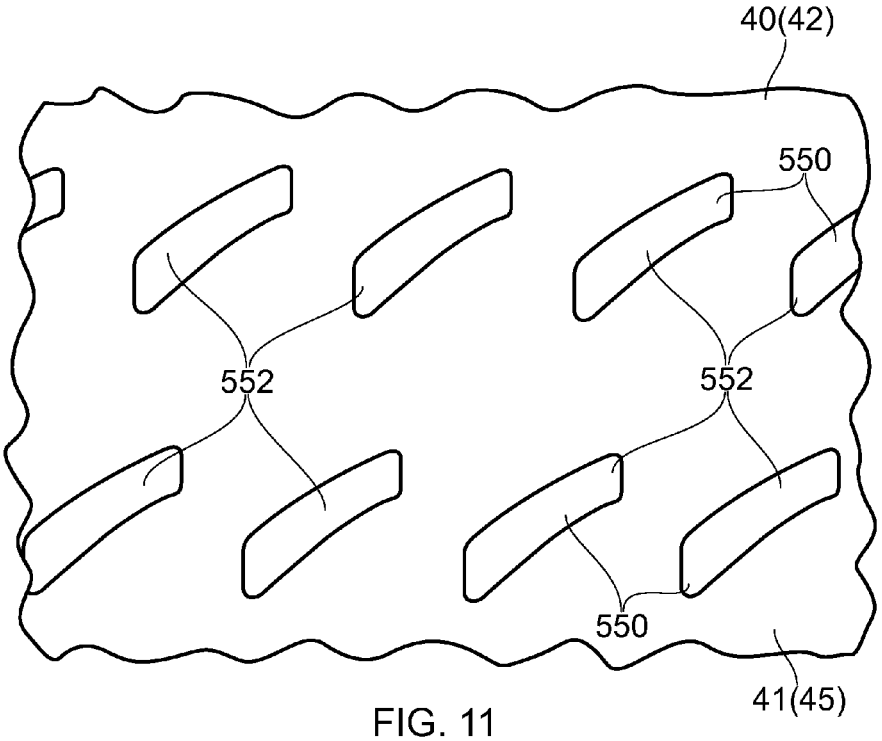
FIG. 11 is a view in the direction of arrow C in FIG. 10 looking at the first surface of the cooled combustion chamber wall.
Figure 12:
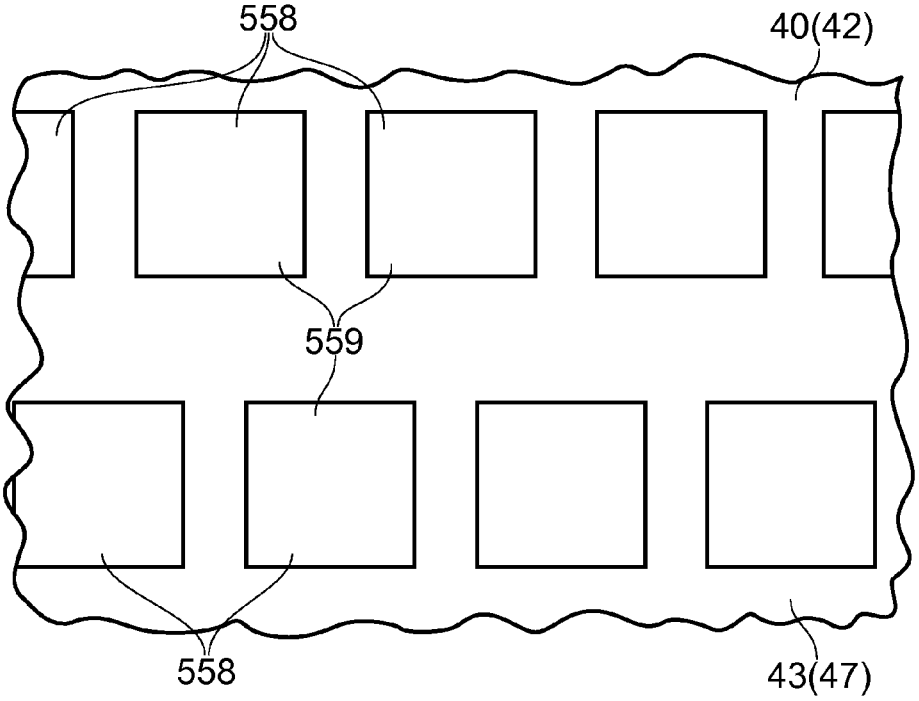
FIG. 12 is a view in the direction of arrow D in FIG. 10 looking at the second surface of the cooled combustion chamber wall.

FIG. 10 shows a cooled component with another alternative effusion cooling aperture and recess. The second surface 43 has a plurality of recesses 558 and each recess 558 has an upstream end 560 and a downstream end 562. The effusion cooling aperture 550 and recess 558 are substantially the same as that shown in FIG. 9, but the effusion cooling aperture 550 comprises an elongate metering portion 556 and the width W is greater than the length L1 of the metering portion 556. Each aperture 550 has a metering portion 556 and a diffusing portion 557 arranged in flow series. Each effusion cooling aperture 550 as mentioned previously has an inlet 552 in the first surface 41 and an outlet 554 in a corresponding one of the recesses 558 in the second surface 43 and in particular each effusion cooling aperture 550 extends from the first surface 41 to the planar upstream end surface 564 of the corresponding one of the recesses 558 in the second surface 43. Each inlet 552 has an elongate shape in the first surface 41 of the inner annular wall 40 and the inlet 552 in the wall 40 is arranged substantially diagonally with respect to the opening of the recess 558 in the inner annular wall 40, as shown in FIG. 11. Each recess 558 has a rectangular shaped opening in the second surface 43 of the inner annular wall 40, as shown in FIG. 12. Each aperture 550 effectively increases in dimension in length from the inlet 552 of the metering portion 556 in the first surface 41 to the opening of the recess 558 in the second surface 43.

Figure 13:
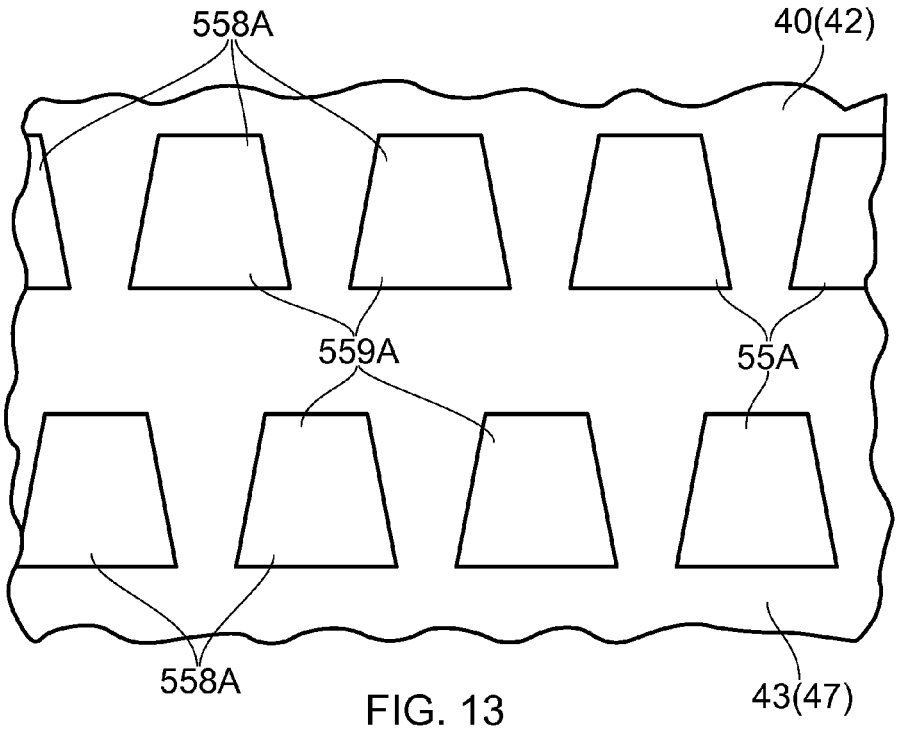
FIG. 13 is an alternative view in the direction of arrow D in FIG. 10 looking at the second surface of the cooled combustion chamber wall.
Figure 14:
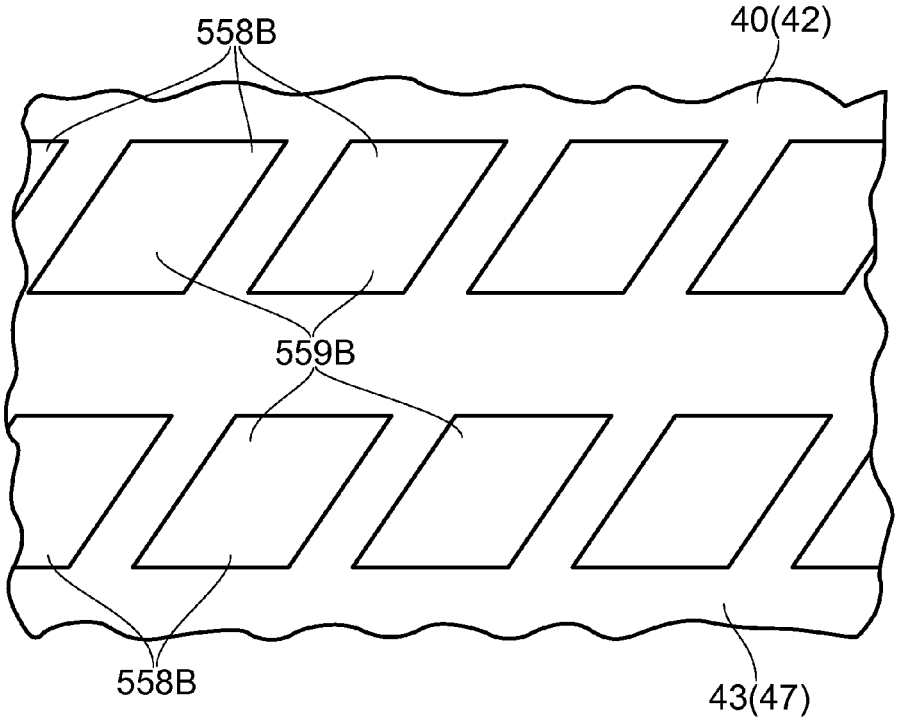
FIG. 14 is another alternative view in the direction of arrow D in FIG. 10 looking at the second surface of the cooled combustion chamber wall.

Alternatively, each recess 558A has an isosceles trapezium shaped opening in the second surface 43 of the inner annular wall 40, as shown in FIG. 13. In a further alternative, each recess 558B has a rhombus shaped opening in the second surface 43 of the inner annular wall 40, as shown in FIG. 14.

Figure 15:
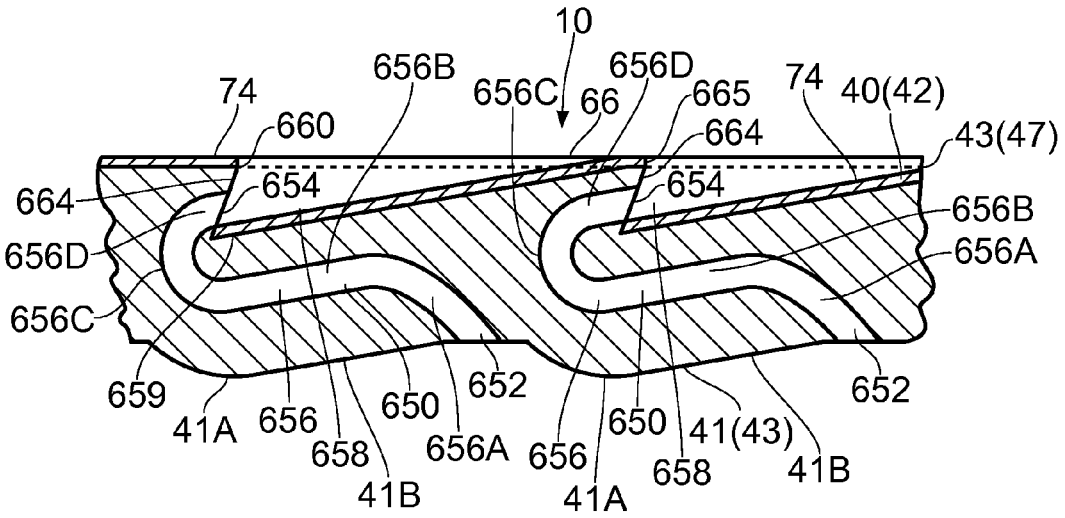
FIG. 15 is a longitudinal cross-sectional view of an alternative cooled combustion chamber wall with a thermal barrier coating on the second surface.

FIG. 15 shows a cooled component with another alternative effusion cooling aperture and recess. The second surface 43 has a plurality of recesses 658 and each recess 658 has an upstream end 660 and a downstream end 662. The effusion cooling aperture 650 and recess 658 are substantially the same as that shown in FIG. 9, but the effusion cooling aperture 650 comprises an elongate metering portion 656 and the width W is greater than the length L1 of the metering portion 656. Each aperture 650 has a metering portion 656 and a diffusing portion 657 arranged in flow series. Each effusion cooling aperture 650 as mentioned previously has an inlet 652 in the first surface 41 and the outlet 654 is in a corresponding one of the recesses 658 in the second surface 43 and in particular each effusion cooling aperture 650 extends from the first surface 41 to the planar upstream end surface 664 of the corresponding one of the recesses 658 in the second surface 43. Each inlet 652 has an elongate shape in the first surface 41 of the inner annular wall 40 and the inlet 652 in the wall 40 is arranged substantially diagonally with respect to the outlet of the recess 658 in the inner annular wall 40, similar to that shown in FIG. 11. Each recess 658 has a rectangular shaped opening in the second surface 43 of the inner annular wall 40, similar to that shown in FIG. 12. Each aperture 650 effectively increases in dimension in length from the inlet 652 of the metering portion 656 in the first surface 41 to the opening of the recess 658 in the second surface 43.

The metering portion 656 of each effusion cooling aperture 650 comprises an inlet portion 656A, a longitudinally upstream extending portion 656B, a U-shaped bend portion 656C and a longitudinally downstream extending portion 656D, as shown in FIG. 15. The longitudinally downstream extending portion 656D is connected to the outlet 654 into the recess 658 of the effusion cooling aperture 650. The longitudinally upstream extending portion 656B and the longitudinally downstream extending portion 656D are substantially parallel. The longitudinally upstream extending portion 656B and the longitudinally downstream extending portion 656D of the metering portion 656 and the bottom surface 659 of the recess 658 are substantially parallel.

It is to be noted that the inlet 652 of each effusion cooling aperture 650 is arranged substantially diagonally, extending with lateral, circumferential, and longitudinal, axial, components and the opening of each recess 658 in the second surface 43 is rectangular in shape. The metering portion 656 of each effusion cooling aperture 650 gradually changes the effusion cooling aperture 650 from the diagonal alignment at the inlet 652 to a rectangular shape at the junction between the inlet portion 656A and the longitudinally upstream extending portion 656B. The gradual changes in the effusion cooling aperture 650 between the diagonal alignment to the rectangular shape at the junction between the inlet portion 656A and the longitudinally upstream extending portion 656B and the recess 658 are preferably designed to be aerodynamic. The opening of the recess 658 is designed to aerodynamically blend to the second surface 53.

The first surface 41 of the radially inner annular wall 40 is provided with a plurality of rows of bulges 41A, the bulges 41A in each row are laterally, circumferentially, spaced and the rows of bulges 41A are longitudinally, axially, spaced on the radially inner annular wall 40. The bulges 41A are localised regions where the first surface 41 of the radially inner annular wall 40 is curved to a maximum distance from the second surface 43 of the radially inner annular wall 40. The U-shaped bend portion 656C of the metering portion 56 of each effusion cooling aperture 650 is aligned laterally, circumferentially, and longitudinally, axially, with a corresponding one of the bulges 41A in the first surface 41. In particular the junction between the longitudinally upstream extending portion 656B and the U-shaped bend portion 656C of each effusion cooling aperture 650 is aligned longitudinally, axially, with the point of an associated bulge 41A which is at a maximum distance from the second surface 43 of the radially inner annular wall 40. The U-bend shaped portion 656C of each effusion cooling aperture 650 is the most upstream portion of the effusion cooling aperture 650. The longitudinally upstream extending portion 656B of each effusion cooling aperture 650 is arranged substantially parallel with a portion 41B of the first surface 41 of the radially inner annular wall 40 between the bulge 41A aligned with the junction between the longitudinally upstream extending portion 656B and the U-shaped bend portion 656C of that effusion cooling aperture 650 and the inlet 652 of that effusion cooling aperture 650.

Alternatively, the first surface 41 of the radially inner annular wall 40 is corrugated and the corrugations 41A are longitudinally, axially, spaced and the corrugations 41A extend laterally, circumferentially, of the radially inner annular wall 40. The corrugations 41A are regions where the first surface 41 of the radially inner annular wall 40 is curved to a maximum distance from the second surface 43 of the radially inner annular wall 40. The U-shaped bend portion 656C of the metering portion 656 of each effusion cooling aperture 650 is aligned longitudinally, axially, with a corresponding one of the corrugations 41A in the first surface 41. In particular the junction between the longitudinally upstream extending portion 656B and the U-shaped bend portion 656C of each effusion cooling aperture 650 is aligned longitudinally, axially, with the point of an associated corrugation 41A which is at a maximum distance from the second surface 43 of the radially inner annular wall 40. The U-bend shaped portion 656C of each effusion cooling aperture 650 is the most upstream portion of the effusion cooling aperture 650. The longitudinally upstream extending portion 656B of each effusion cooling aperture 650 is arranged substantially parallel with a portion 41B of the first surface 41 of the radially inner annular wall 40 between the corrugation 41A aligned with the junction between the longitudinally upstream extending portion 56B and the U-shaped bend portion 656C of that effusion cooling aperture 650 and the inlet 652 of that effusion cooling aperture 650.

The U-shaped bend portion 656B of each effusion cooling aperture 650 has a curved upstream end wall and the curved upstream surface is convex so as to enable the effusion cooling aperture 650 to be manufactured by additive layer manufacturing. The U-shaped bend portion 656B of each effusion cooling aperture 650 also has a curved downstream end wall and the curved downstream surface is concave so as to enable the effusion cooling aperture 650 to be manufactured by additive layer manufacturing. The laterally spaced end walls of each U-shaped bend portion 656B of each effusion cooling aperture 650 may be planar or may be curved. The laterally spaced end walls of the metering portion 656 of each effusion cooling aperture 650 may be planar or may be curved, e.g. concave.

It is to be noted that the inlet 652 of each effusion cooling aperture 650 is axially downstream of the U-shaped bend portion 656B of the metering portion 656 of the effusion cooling aperture 650 and the outlet 654 of each effusion cooling aperture 650 is axially downstream of the U-shaped bend portion 656B of the metering portion 656 of the effusion cooling aperture 650.

Alternatively, each recess 658 may have an isosceles trapezium shaped opening in the second surface of the inner annular wall, similar to that shown in FIG. 13. In a further alternative, each recess 658 may have a rhombus shaped opening in the second surface of the inner annular wall, similar to that shown in FIG. 14.

Figure 16:
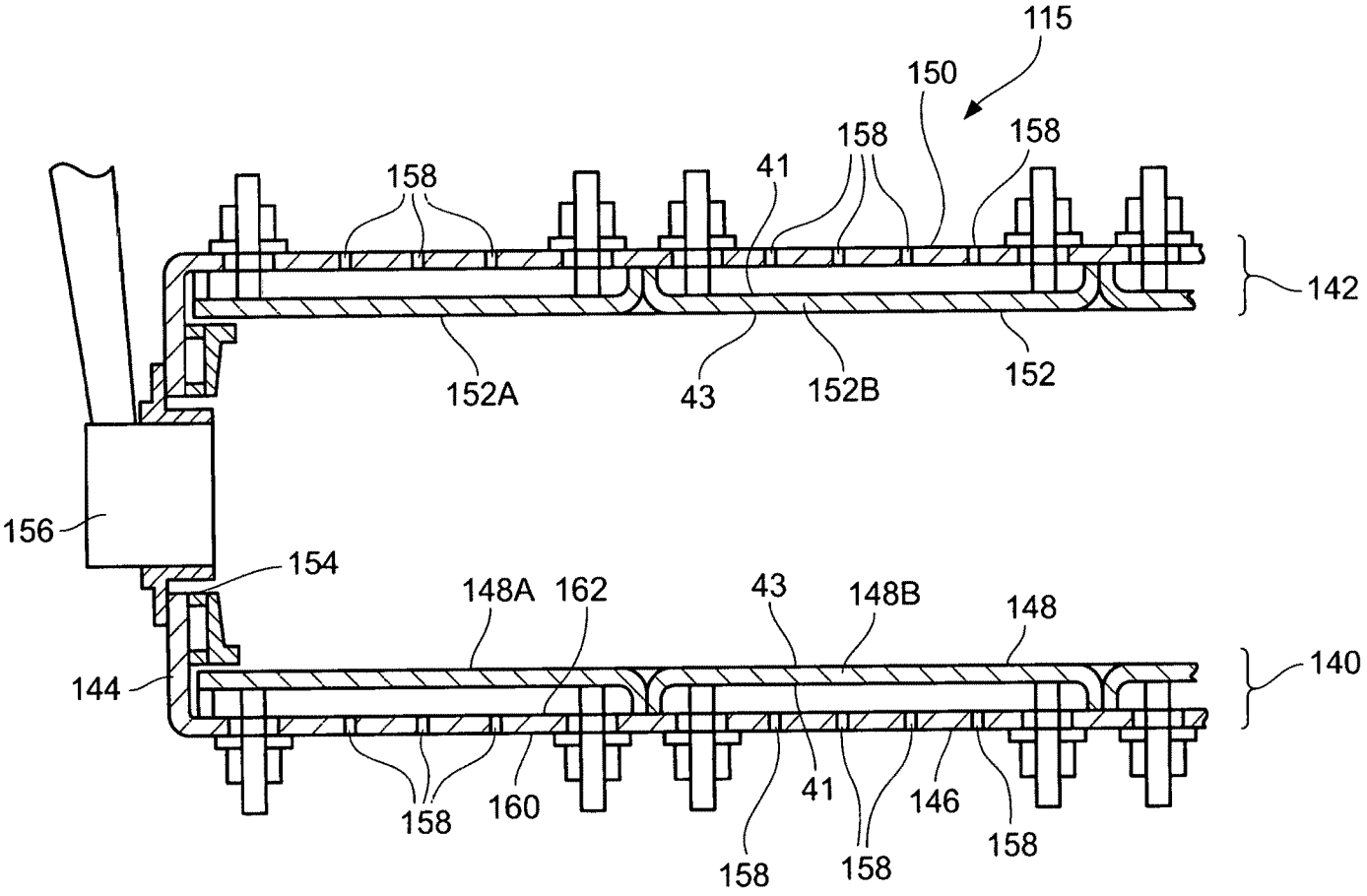
FIG. 16 is an enlarged cross-sectional view of an alternative cooled combustion chamber wall according to the present disclosure.

Another combustion chamber 115, as shown more clearly in FIG. 16, is an annular combustion chamber and comprises a radially inner annular wall structure 140, a radially outer annular wall structure 142 and an upstream end wall structure 144. The radially inner annular wall structure 140 comprises a first annular wall 146 and a second annular wall 148. The radially outer annular wall structure 142 comprises a third annular wall 150 and a fourth annular wall 152. The second annular wall 148 is spaced radially from and is arranged radially around the first annular wall 146 and the first annular wall 146 supports the second annular wall 148. The fourth annular wall 152 is spaced radially from and is arranged radially within the third annular wall 150 and the third annular wall 150 supports the fourth annular wall 152. The upstream end of the first annular wall 146 is secured to the upstream end wall structure 144 and the upstream end of the third annular wall 150 is secured to the upstream end wall structure 144. The upstream end wall structure 144 has a plurality of circumferentially spaced apertures 154 and each aperture 154 has a respective one of a plurality of fuel injectors 156 located therein. The fuel injectors 156 are arranged to supply fuel into the annular combustion chamber 115 during operation of the gas turbine engine 10.

The second annular wall 148 comprises a plurality of rows of combustor tiles 148A and 148B and the fourth annular wall 152 comprises a plurality of rows of combustor tiles 152A and 152B. The combustor tiles 148A and 148B have threaded studs to secure the combustor tiles 148A and 148B onto the first annular wall 146 and the combustor tiles 152A and 152B have threaded studs to secure the combustor tiles 152A and 152B onto the third annular wall 150.

The combustor tiles 148A, 148B, 152A and 152B are cooled components of the turbofan gas turbine engine 10. Each of the combustor tiles 148A, 148B, 152A and 152B has a first surface 41 and a second surface 43. The combustion chamber tiles 148A, 148B, 152A and 152B are for annular combustion chamber wall 140 and 142 and each combustion chamber tile 148A, 148B, 152A and 152B has effusion cooling apertures and recesses as shown in FIGS. 3 to 8, effusion cooling apertures and recesses as shown in FIG. 9, effusion cooling apertures and recesses as shown in FIGS. 10 to 14 or effusion cooling apertures and recesses as shown in FIGS. 11 to 15.

Each combustion chamber tile 148A, 148B, 152A and 152B has each recess 58 arranged such that the planar upstream end surfaces 64 which extend laterally extend circumferentially of the combustion chamber tile 148A, 148B, 152A and 152B and the side surfaces 66 and 68 which extend longitudinally extend axially of the combustion chamber tile 148A, 148B, 152A and 152B. The recesses 58 are arranged in axially spaced rows and the recesses 58 in each row are circumferentially spaced apart. The effusion cooling apertures 50 are arranged in axially spaced rows and the apertures 50 in each row are circumferentially spaced apart. The recesses 58 in each row are offset circumferentially from the recesses 58 in each adjacent row. The effusion cooling apertures 50 in each row are offset circumferentially from the effusion cooling apertures 50 in each adjacent row.

The first annular wall 146 and the third annular wall 150 are provided with a plurality of impingement cooling apertures extending there-through to direct coolant onto the first surfaces 41 of the combustor tiles 148A, 148B, 152A and 152B.

In operation coolant, for example air supplied from the high pressure compressor 14 of the gas turbine engine 10, flowing over the radially inner and outer annular wall structures 140 and 142 respectively is supplied through the impingement cooling apertures in the first and third annular walls 146 and 150 and onto the first surfaces 41 of the combustor tiles 148A, 148B, 152A and 152B of the second and fourth annular walls 148 and 152 to provide impingement cooling of the combustor tiles 148A, 148B, 152A and 152B. The coolant then flows through the effusion cooling apertures 50 in the combustor tiles 148A, 148B, 152A and 152B of the second and fourth annular walls 148 and 152 from the first surface 41 to the second surface 43 of the combustor tiles 148A, 148B, 152A and 152B of the second and fourth annular walls 148 and 152 radially inner and outer annular wall structures 140 and 142 respectively. The flow of coolant through the effusion cooling apertures 50 exits the effusion cooling apertures 50 and then flows over the second surfaces 43 of the combustor tiles 148A, 148B, 152A and 152B of the second and fourth annular walls 148 and 152 of the radially inner and outer annular wall structures 140 and 142 respectively to form a film of coolant on the second surfaces 43 of the combustor tiles 148A, 148B, 152A and 152B of the second and fourth annular walls 148 and 152 of the radially inner and outer annular wall structures 140 and 142 respectively. In particular the flow of coolant exits the outlets 54, in the planar upstream end surfaces 64 of the recesses 58, of the effusion cooling apertures 50 and flows through the recesses 58 and onto the second surfaces 43 of the combustor tiles 148A, 148B, 152A and 152B of the second and fourth annular walls 148 and 152 of the radially inner and outer annular wall structures 140 and 142 respectively.

If the effusion cooling apertures on the combustor tiles 148A, 148B, 152A and 152B are those described with reference to FIG. 15, some of the impingement cooling apertures in the first and third annular walls 146 and 150 are arranged to direct the coolant onto the bulges 41A, or corrugations, 41A on the first surface 41 to increase heat removal from the first surface 41.

Figure 19:
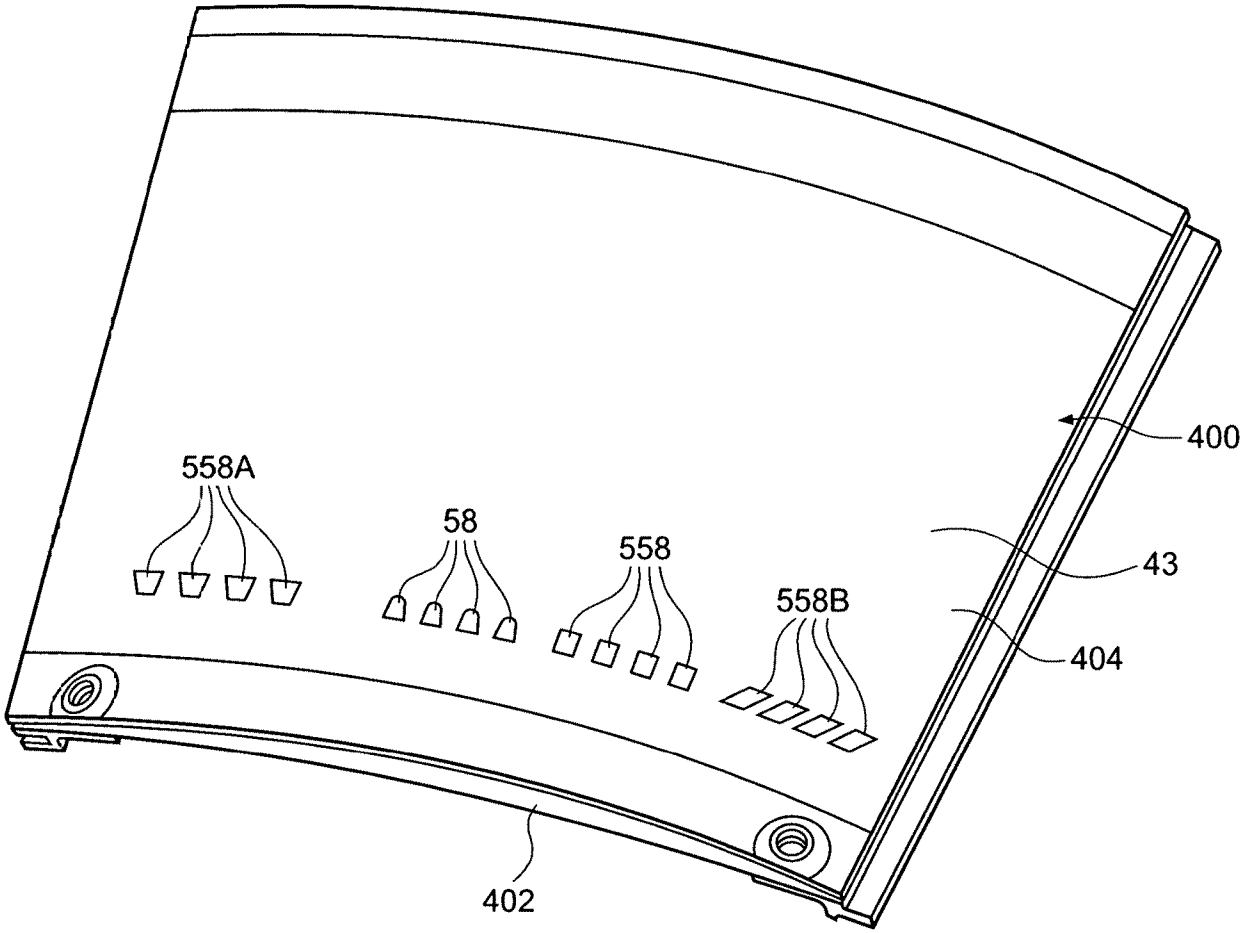
FIG. 19 is a perspective view of a combustion chamber segment according to the present disclosure.

In another arrangement, as shown in FIG. 19, an annular combustion chamber wall comprises a plurality of wall segments 400, as shown in FIG. 19, and each of the combustion chamber wall segments 400 is a cooled component of the gas turbine engine. Each combustion chamber wall segment 400 comprises an outer wall 402 and an inner wall 404 spaced from the inner wall 404, the outer wall 402 has a plurality of impingement cooling apertures and the inner wall has a plurality of effusion cooling apertures and a plurality of recesses 58, 558, 558A, 558B. The inner wall 404 of each combustion chamber wall segment 400 has each recess arranged such that the planar upstream end surfaces which extend laterally extend circumferentially of the combustion chamber segment and the side surfaces which extend longitudinally extend axially of the combustion chamber segment. The recesses 58, 558, 558A, 558B are arranged in axially spaced rows and the recesses in each row are circumferentially spaced apart. The effusion cooling apertures are arranged in axially spaced rows and the apertures in each row are circumferentially spaced apart. The recesses in each row are offset laterally from the recesses in each adjacent row. The effusion cooling apertures in each row are offset circumferentially from the effusion cooling apertures in each adjacent row. The combustion chamber wall segment 400 has effusion cooling apertures and recesses as shown in FIGS. 3 to 8, effusion cooling apertures and recesses as shown in FIG. 9, effusion cooling apertures and recesses as shown in FIGS. 10 to 14 or effusion cooling apertures and recesses as shown in FIGS. 11 to 15.

Figure 17:
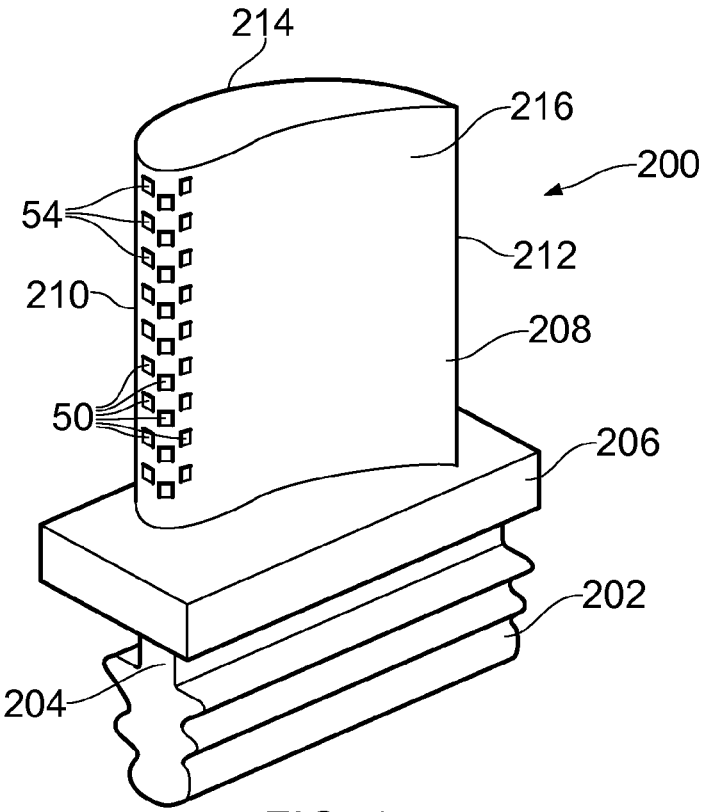
FIG. 17 is a perspective view of cooled turbine blade according to the present disclosure.

A turbine blade 200, as shown more clearly in FIG. 17, comprises a root portion 202, a shank portion 204, a platform portion 206 and an aerofoil portion 208. The aerofoil portion 208 has a leading edge 210, a trailing edge 212, convex wall 214 and a concave wall 216 and the convex and concave walls 214 and 216 extend from the leading edge 210 to the trailing edge 212. The turbine blade 200 is hollow and has a plurality of passages formed therein and is a cooled component of the gas turbine engine 10. The cooled turbine blade 200 has a plurality of effusion cooling apertures 50 extending through the convex and concave walls 214 and 216 respectively of the aerofoil portion 208 to cool the aerofoil portion 208 of the turbine blade 200. The cooled turbine blade 200 has each recess 58 arranged such that the planar upstream end surfaces 64 which extend laterally extend radially of the turbine blade 200 and the side surfaces 66 and 68 which extend longitudinally extend axially of the turbine blade 200. The recesses 58 are arranged in axially spaced rows and the recesses 58 in each row are radially spaced apart. The effusion cooling apertures 50 are arranged in axially spaced rows and the apertures 50 in each row are radially spaced apart. The recesses 58 in each row are offset radially from the recesses 58 in each adjacent row. The effusion cooling apertures 50 in each row are offset radially from the effusion cooling apertures 50 in each adjacent row. The turbine blade 200 has effusion cooling apertures and recesses as shown in FIGS. 3 to 8, effusion cooling apertures and recesses as shown in FIG. 9, effusion cooling apertures and recesses as shown in FIGS. 10 to 14 or effusion cooling apertures and recesses as shown in FIGS. 11 to 15.

In operation coolant, for example air supplied from the high pressure compressor 14 of the gas turbine engine 10, is supplied into the passages within the turbine blade 200 and the coolant flows through the effusion cooling apertures 50 from the first surface 41 to the second surface 43 of the convex and concave walls 214 and 216 respectively of the aerofoil portion 208. The flow of coolant through the effusion cooling apertures 50 exits the effusion cooling apertures 50 and then flows over the second surfaces 43 of the convex and concave walls 214 and 216 respectively of the aerofoil portion 208 to form a film of coolant on the second surfaces 43 of the convex and concave walls 214 and 216 respectively of the aerofoil portion 208. In particular the flow of coolant exits the outlets 54, in the planar upstream end surfaces 64 of the recesses 58, of the effusion cooling apertures 50 and flows through the recesses 58 and onto the second surfaces 43 of the turbine blade 200.

Figure 18:
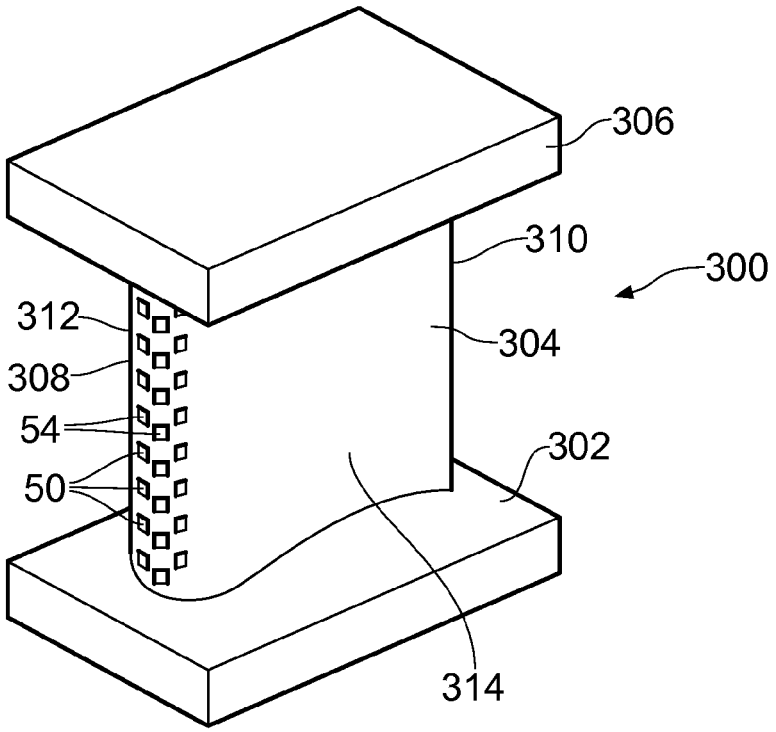
FIG. 18 is a perspective view of a cooled turbine vane according to the present disclosure.

A turbine vane 300, as shown more clearly in FIG. 18, comprises an inner platform portion 302, an aerofoil portion 304 and an outer platform portion 306. The aerofoil portion 304 has a leading edge 308, a trailing edge 310, convex wall 312 and a concave wall 314 and the convex and concave walls 312 and 314 extend from the leading edge 308 to the trailing edge 310. The turbine vane 300 is hollow and has a plurality of passages formed therein and is a cooled component of the gas turbine engine 10. The cooled turbine vane 300 has a plurality of effusion cooling apertures 50 extending through the convex and concave walls 312 and 314 respectively of the aerofoil portion 304 to cool the aerofoil portion 304 of the turbine vane 300. The cooled turbine vane 300 has each recess 58 arranged such that the planar upstream end surfaces 64 which extend laterally extend radially of the turbine vane 300 and the side surfaces 66 and 68 which extend longitudinally extend axially of the turbine vane 300. The recesses 58 are arranged in axially spaced rows and the recesses 58 in each row are radially spaced apart. The effusion cooling apertures 50 are arranged in axially spaced rows and the apertures 50 in each row are radially spaced apart. The recesses 58 in each row are offset radially from the recesses 58 in each adjacent row. The effusion cooling apertures 50 in each row are offset radially from the effusion cooling apertures 50 in each adjacent row. The turbine vane 300 has effusion cooling apertures and recesses as shown in FIGS. 3 to 8, effusion cooling apertures and recesses as shown in FIG. 9, effusion cooling apertures and recesses as shown in FIGS. 10 to 14 or effusion cooling apertures and recesses as shown in FIGS. 11 to 15.

In operation coolant, for example air supplied from the high pressure compressor 14 of the gas turbine engine 10, is supplied into the passages within the turbine vane 300 and the coolant flows through the effusion cooling apertures 50 from the first surface 41 to the second surface 43 of the convex and concave walls 312 and 314 respectively of the aerofoil portion 304. The flow of coolant through the effusion cooling apertures 50 exits the effusion cooling apertures 50 and then flows over the second surfaces 43 of the convex and concave walls 312 and 314 respectively of the aerofoil portion 304 to form a film of coolant on the second surfaces 43 of the convex and concave walls 312 and 314 respectively of the aerofoil portion 304. In particular the flow of coolant exits the outlets 54, in the planar upstream end surfaces 64 of the recesses 58, of the effusion cooling apertures 50 and flows through the recesses 58 and onto the second surfaces 43 of the turbine vane 300.

The turbine blade 200 may additionally have effusion cooling apertures and recesses in the platform portion 206 and/or the turbine vane 300 may additionally have effusion cooling apertures and recesses in the inner and/or outer platform portions 302 and 304 respectively.

In any of the embodiments discussed above, the cooled component may comprise a second wall, the second wall being spaced from the first surface of the wall, the second wall having a third surface 160 and a fourth surface 162, the fourth surface 162 of the second wall being spaced from the first surface of the wall and the second wall having a plurality of impingement cooling apertures 158 extending there-through from the third surface 160 to the fourth surface 162, as shown in FIG. 16.

It is to be noted that the effusion cooling apertures are inclined in the direction of flow of the hot gases over the cooled component.

The cooled components, the cooled combustor chamber wall, the cooled combustion chamber combustor tile, the cooled combustion chamber heat shield, the cooled combustion chamber wall segment, the cooled turbine blade, the cooled turbine vane or cooled turbine shroud are preferably formed by additive layer manufacturing, for example direct laser deposition, selective laser sintering or direct electron beam deposition. The cooled component is built up layer by layer using additive layer manufacturing in the longitudinal, axial, direction of the wall which corresponds to the direction of flow of hot gases over the second surface of the wall.

The cooled combustion chamber walls may be manufactured by direct laser deposition in a powder bed by producing a spiral shaped wall sintering the powder metal layer by layer, (in the longitudinal, axial, direction of the wall) and then unravelling and welding, bonding, brazing or fastening the ends of what was the spiral shaped wall together to form an annular combustion chamber wall. The combustion chamber tiles may be manufactured by direct laser deposition in a powder bed by sintering the powder metal layer by layer in the longitudinal, axial, direction of the combustion chamber tile. The combustion chamber segments may be manufactured by direct laser deposition in a powder bed by sintering the powder metal layer by layer in the longitudinal, axial, direction of the combustion chamber tile.

The cooled components, the cooled combustor chamber wall, the cooled combustion chamber combustor tile, the cooled combustion chamber heat shield, the cooled combustion chamber wall segment, the cooled turbine blade, the cooled turbine vane or cooled turbine shroud may be formed by casting and the effusion cooling apertures and recesses may be formed by laser drilling, electro-discharge machining or electro-chemical machining. The cooled components, the cooled combustor chamber wall, the cooled combustion chamber combustor tile, the cooled combustion chamber heat shield, the cooled combustion chamber wall segment, the cooled turbine blade, the cooled turbine vane or cooled turbine shroud with recesses in the second surface may be formed by casting and the effusion cooling apertures may be formed by laser drilling, electro-discharge machining or electro-chemical machining.

The cooled components comprise a superalloy, for example a nickel, or cobalt, superalloy. The thermal barrier coating may comprise a ceramic coating or a metallic bond coating and a ceramic coating. The ceramic coating may comprise zirconia, for example stabilised zirconia, e.g. yttria stabilised zirconia, ceria stabilised zirconia, yttria and erbia stabilised zirconia etc. The metallic bond coating may comprise an aluminide coating, e.g. a platinum aluminide coating, a chromium aluminide coating, a platinum chromium aluminide coating, a silicide aluminide coating or a MCrAlY coating where M is one or more of iron, nickel and cobalt, Cr is chromium, Al is aluminium and Y is a rare earth metal, e.g. yttrium, lanthanum etc.

The cooled component may be a turbine blade, a turbine vane, a combustion chamber wall, a combustion chamber tile, a combustion chamber heat shield, a combustion chamber wall segment or a turbine shroud.

The cooled component may be a gas turbine engine component or other turbomachine component, e.g. a steam turbine, or an internal combustion engine etc.

The gas turbine engine may be an aero gas turbine engine, an industrial gas turbine engine, a marine gas turbine engine or an automotive gas turbine engine. The aero gas turbine engine may be a turbofan gas turbine engine, a turbo-shaft gas turbine engine, a turbo-propeller gas turbine engine or a turbojet gas turbine engine.

Thus, in each of the embodiments described above each recess is arranged such that the planar upstream end surface extends laterally and the side surfaces extend longitudinally. The recesses are arranged in longitudinally spaced rows and the recesses in each row are laterally spaced apart. The effusion cooling apertures are arranged in longitudinally spaced rows and the apertures in each row are laterally spaced apart. The recesses in each row are offset laterally from the recesses in each adjacent row. The effusion cooling apertures in each row are offset laterally from the effusion cooling apertures in each adjacent row.

The advantage of the present disclosure is that the recesses and effusion cooling apertures are arranged such that a thermal barrier coating subsequently applied onto the second surface minimises, or avoids, blockage of the effusion cooling apertures and minimises aerodynamic disturbance of the coolant flow through the effusion cooling apertures. The present disclosure allows a thermal barrier coating to be applied to the second surface of the component after the effusion cooling apertures have been formed with minimum blockage of the effusion cooling apertures and minimum aerodynamic disturbance of the coolant flow through the effusion cooling apertures. Each recess and associated effusion cooling aperture is arranged such that the recess has a depth equal to the required finished depth of the recess plus the thickness of the thermal barrier coating. Each recess is provided with a planar upstream end surface and the outlet of the associated effusion cooling aperture is provided in the planar upstream end surface. Each recess and associated effusion cooling aperture is arranged so that the planar upstream end surface hangs over the upstream end of the recess such that the outlet of the associated effusion cooing aperture is shadowed by the overhang and blockage of the outlet of the effusion cooling apertures is minimised, or avoided. Each recess has a smoothly curved transition from the planar upstream end surface to the second surface to minimise, or avoid, the thermal barrier coating, "snow-drifting", building up over the outlet of the associated effusion cooling aperture. Each recess has side surfaces angled to the second surface and each recess has smoothly curved transitions from the side surfaces to the second surface to minimise, or avoid, the thermal barrier coating, "snow-drifting", building up over the side surfaces of the recess which creates a thermal barrier coating with non-uniform thickness and furthermore creates un-aerodynamic edges which disrupt the coolant flow exiting the effusion cooling aperture. The effusion cooling apertures with a diffusion portion have additional advantages in that the diffusing portion is within the body of the cooled component leading to the outlet in the planar upstream end surface and is thus defined by the cooled component and is not defined by the thickness of the thermal barrier coating. If thermal barrier coating were to enter the outlet of the effusion cooling aperture then only the diffusing portion of the effusion cooling aperture is partially blocked and not the metering portion of the effusion cooling aperture. Thus, there is minimal effusion cooling aperture blockage, the depth of the recess may be tailored to match the thickness of the thermal barrier coating, component cost and inspection cost are reduced, the thermal barrier coating has a more uniform thickness, the working life of the cooled component is increased due to reduced thermal barrier coating loss and to more uniform thermal barrier coating thickness and there is improved aerodynamic interface between the effusion cooing apertures and the thermal barrier coating.

Although the present disclosure has referred to effusion cooling apertures with circular cross-sectional metering portions it is also applicable to effusion cooling apertures with other cross-sectional shapes of metering portions, e.g. elliptical, slots, fanned. Although the present disclosure has been described with reference to recesses with rectangular shape, square shape, isosceles trapezium shape and rhombus shape outlet in the surface of the component it may be possible to use parallelogram shapes or any other suitable quadrilateral shape.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

The invention claimed is:

1. A cooled component comprising a wall having a first surface and a second surface, the second surface having a plurality of recesses, each recess of the plurality of recesses having an upstream end and a downstream end, each recess of the plurality of recesses having a planar upstream end surface arranged at a first angle of more than 100° to the second surface such that the planar upstream end surface hangs over the upstream end of the respective recess, each recess of the plurality of recesses having a first smoothly curved transition from the planar upstream end surface to the second surface, each recess of the plurality of recesses reducing in depth from the upstream end of the recess to the downstream end of the recess, each recess of the plurality of recesses having side surfaces, wherein each side surface of each respective recess is arranged at a second angle of less than 80° to the second surface and each recess of the plurality of recesses having second smoothly curved transitions from the side surfaces to the second surface, the wall having a plurality of effusion cooling apertures extending there-through from the first surface towards the second surface, each effusion cooling aperture of the plurality of effusion cooling apertures being arranged at a third angle to the first surface, each effusion cooling aperture of the plurality of effusion cooling apertures having an inlet in the first surface and an outlet in a corresponding recess of the plurality of recesses in the second surface, each effusion cooling aperture of the plurality of effusion cooling apertures extending from the first surface to the planar upstream end surface of the corresponding recess of the plurality of recesses in the second surface.

2. The cooled component as claimed in claim 1, wherein the side surfaces of each recess of the plurality of recesses converge from the upstream end of the recess to the downstream end of the recess.

3. The cooled component as claimed in claim 2, wherein each recess of the plurality of recesses has a shaped opening in the second surface selected from the group consisting of: a triangular shaped opening in the second surface and a part elliptically shaped opening in the second surface.

4. The cooled component as claimed in claim 1, wherein the side surfaces of each recess of the plurality of recesses diverge from one another from the upstream end of the recess to the downstream end of the recess.

5. The cooled component as claimed in claim 4, wherein each recess of the plurality of recesses has an isosceles trapezium shaped opening in the second surface.

6. The cooled component as claimed in claim 1, wherein the side surfaces of each recess of the plurality of recesses are parallel to one another from the upstream end of the recess to the downstream end of the recess.

7. The cooled component as claimed in claim 6, wherein each recess of the plurality of recesses has a shaped opening in the second surface selected from the group consisting of: a rectangular shaped opening in the second surface, a square shaped opening in the second surface and a rhombus shaped opening in the second surface.

8. The cooled component as claimed in claim 1, wherein each effusion cooling aperture of the plurality of effusion cooling apertures has a metering portion between the inlet and the outlet.

9. The cooled component as claimed in claim 1, wherein each effusion cooling aperture of the plurality of effusion cooling apertures has a metering portion and a diffusing portion arranged in flow series between the inlet and the outlet.

10. The cooled component as claimed in claim 1, wherein each effusion cooling aperture of the plurality of effusion cooling apertures is arranged parallel to a bottom of the corresponding recess of the plurality of recesses.

11. The cooled component as claimed in claim 1, wherein the first angle is 105° to the second surface.

12. The cooled component as claimed in claim 1, wherein the second angle is 75° to the second surface.

13. The cooled component as claimed in claim 1, wherein the inlet of each effusion cooling aperture of the plurality of effusion cooling apertures in the first surface is an elliptically shaped inlet.

14. The cooled component as claimed in claim 1, wherein each effusion cooling aperture has a circular cross-section metering portion.

15. The cooled component as claimed in claim 9, wherein each effusion cooling aperture of the plurality of effusion cooling apertures diverges in the diffusing portion.

16. The cooled component as claimed in claim 8, wherein the metering portion is arranged at an angle of between 10° and 30° to the first surface.

17. The cooled component as claimed in claim 1, wherein the cooled component has a thermal barrier coating on the second surface, each recess of the plurality of recesses having a depth equal to a finished depth plus a thickness of the thermal barrier coating to be deposited.

18. The cooled component as claimed in claim 1, wherein the cooled component comprises a second wall, the second wall having a third surface and a fourth surface, the fourth surface of the second wall being spaced from the first surface of the wall and the second wall having a plurality of impingement cooling apertures extending there-through from the third surface to the fourth surface.

19. The cooled component as claimed in claim 1, wherein the cooled component is selected from the group consisting of: a turbine blade, a turbine vane, a combustion chamber wall, a combustion chamber tile, a combustion chamber heat shield, a combustion chamber wall segment, and a turbine shroud.

20. The cooled component as claimed in claim 19, wherein the cooled component is an annular combustion chamber wall and the annular combustion chamber wall has each recess of the plurality of recesses arranged such that each planar upstream end surface of the respective recess, which extends laterally, extends circumferentially around the annular combustion chamber wall and the side surfaces, which extend longitudinally, extend axially with respect to the annular combustion chamber wall.

21. The cooled component as claimed in claim 19, wherein the cooled component is the combustion chamber tile for an annular combustion chamber wall and the combustion chamber tile has each recess of the plurality of recesses arranged such that each planar upstream end surface of the respective recess, which extends laterally, extends circumferentially around the combustion chamber tile and the side surfaces, which extend longitudinally, extend axially with respect to the combustion chamber tile.

22. The cooled component as claimed in claim 19, wherein the cooled component is the combustion chamber wall segment for an annular combustion chamber wall and the combustion chamber wall segment comprises an outer wall and an inner wall, wherein the outer wall is spaced from the inner wall, the outer wall has a plurality of impingement cooling apertures and the inner wall has the plurality of effusion cooling apertures, the inner wall has each recess of the plurality of recesses arranged such that each planar upstream end surface of the respective recess, which extends laterally, extends circumferentially of the combustion chamber wall segment and the side surfaces, which extend longitudinally, extend axially with respect to the combustion chamber wall segment.

23. The cooled component as claimed in claim 1, wherein the cooled component comprises a superalloy.

24. The cooled component as claimed in claim 1, wherein the cooled component is manufactured by additive layer manufacturing.

25. The cooled component as claimed in claim 1, wherein the cooled component is selected from the group consisting of a gas turbine engine component, other turbomachine component, a steam turbine component, and an internal combustion engine component.

* * * * *